US008600253B2

(12) United States Patent
Kanno

(10) Patent No.: US 8,600,253 B2
(45) Date of Patent: Dec. 3, 2013

(54) IMAGE FORMING APPARATUS, METHOD OF CONTROLLING FIXING DEVICE, AND DEVICE AND METHOD FOR DETECTING ABNORMALITY OF THE FIXING DEVICE

(75) Inventor: Satoru Kanno, Kashiwa (JP)

(73) Assignee: Canon Kabushiki Kaisha (JP)

( * ) Notice: Subject to any disclaimer, the term of this patent is extended or adjusted under 35 U.S.C. 154(b) by 0 days.

(21) Appl. No.: 13/230,327

(22) Filed: Sep. 12, 2011

(65) Prior Publication Data

US 2011/0318040 A1 Dec. 29, 2011

Related U.S. Application Data

(63) Continuation of application No. 12/128,153, filed on May 28, 2008, now Pat. No. 8,036,545.

(30) Foreign Application Priority Data

May 30, 2007 (JP) ..... 2007-143848

(51) Int. Cl.
*G03G 15/20* (2006.01)

(52) U.S. Cl.
USPC ..... 399/69; 399/33; 399/320; 399/328; 399/330; 399/331; 219/619

(58) Field of Classification Search
USPC ..... 399/33, 67, 122, 320
See application file for complete search history.

(56) References Cited

U.S. PATENT DOCUMENTS 5,111,249 A 5/1992 Owada
5,737,664 A 4/1998 Fukuda et al.
7,043,167 B2 * 5/2006 Ichikawa et al. ..... 399/12
7,212,754 B2 5/2007 Fujiwara
7,536,145 B2 5/2009 Tomine et al.
7,542,692 B2 6/2009 Yamamoto et al.
7,620,337 B2 * 11/2009 Nakamoto et al. ..... 399/69

(Continued)

FOREIGN PATENT DOCUMENTS

JP 11-15303 A 1/1999
JP 2003057989 A * 2/2003

(Continued)

OTHER PUBLICATIONS

Japanese Office Action dated Jul. 3, 2012 for corresponding JP 2007-143848.

*Primary Examiner* — David Gray
*Assistant Examiner* — Francis Gray
(74) *Attorney, Agent, or Firm* — Rossi, Kimms & McDowell LLP

(57) ABSTRACT

An image forming apparatus which is capable of detecting occurrence of an abnormality that a fixing member which is actually in an unpressurized state is detected to be in a pressurized state, and supply of electric power to a heating member is continued. A fixing device includes a fixing belt and a pressure roller. The fixing belt and the pressure roller are pressed against each other such that a nip is formed therebetween, for nipping and conveying a transfer material through the nip while heating and pressing the same. A pressurizing unit selectively switches between a pressurizing state and an unpressurizing state. When the pressurizing unit is in the pressurized state, a heater heats the fixing belt. The heating of the fixing belt is stopped based on a temperature detected by a thermistor after a lapse of a predetermined time period from start of the heating.

14 Claims, 10 Drawing Sheets

(56) References Cited

U.S. PATENT DOCUMENTS

| | | | | |
|---|---|---|---|---|
| 7,778,564 | B2 | 8/2010 | Sone et al. | |
| 7,925,197 | B2 * | 4/2011 | Takagi et al. | 399/329 |
| 2002/0127022 | A1 | 9/2002 | Tanaka | |
| 2005/0013626 | A1 | 1/2005 | Satoh et al. | |
| 2005/0063724 | A1 | 3/2005 | Kodama | |
| 2005/0254845 | A1 | 11/2005 | Taki et al. | |
| 2006/0280520 | A1 | 12/2006 | Inada | |
| 2007/0019977 | A1 | 1/2007 | Sawamura et al. | |
| 2007/0059002 | A1 * | 3/2007 | Yamamoto et al. | 399/45 |
| 2007/0134009 | A1 * | 6/2007 | Choi et al. | 399/33 |
| 2007/0217839 | A1 | 9/2007 | Moteki et al. | |
| 2007/0230983 | A1 * | 10/2007 | Nakamoto et al. | 399/69 |
| 2008/0101805 | A1 | 5/2008 | Hyun | |
| 2008/0187333 | A1 | 8/2008 | Hwang | |
| 2008/0292345 | A1 | 11/2008 | Kang | |
| 2009/0180792 | A1 | 7/2009 | Hayamizu | |

FOREIGN PATENT DOCUMENTS

| | | | |
|---|---|---|---|
| JP | 2003-162175 | A | 6/2003 |
| JP | 2005-321511 | A | 11/2005 |
| JP | 2006-243288 | A | 9/2006 |
| JP | 2008102413 | A * | 5/2008 |

* cited by examiner

IMAGE FORMING APPARATUS, METHOD OF CONTROLLING FIXING DEVICE, AND DEVICE AND METHOD FOR DETECTING ABNORMALITY OF THE FIXING DEVICE

CROSS REFERENCE

This is a continuation of application Ser. No. 12/128,153 filed 28 May 2008, the entire contents of which are herein incorporated by reference.

BACKGROUND OF THE INVENTION

1. Field of the Invention

The present invention relates to an image forming apparatus, a method of controlling a fixing device, and a device and method for detecting abnormality of the fixing device.

2. Description of the Related Art

As an image forming apparatus, such as a copying machine and a printer, there recently appeared on the market a color image forming apparatus capable of forming a color image on a sheet. A known fixing device for use in the color image forming apparatus includes a fixing roller having an elastic layer formed on a surface thereof. The fixing roller is heated until the temperature of the surface thereof reaches a suitable temperature (fixable temperature) for fixing a toner image on a transfer material. However, the fixing roller has a large heat capacity, and hence it takes a longer time period (warm-up time) to heat the fixing roller until the surface of the fixing roller reaches the fixable temperature.

On the other hand, as a fixing device which makes it possible to reduce warm-up time, there has been known one using a fixing film. The configuration of the fixing device using the fixing film will be described with reference to FIG. 14. FIG. 14 is a longitudinal cross-sectional view of essential parts of the conventional fixing device using the fixing film.

As shown in FIG. 14, the fixing device is comprised of a fixing film 911 in the form of a hollow cylinder and a pressure roller 914. The fixing film 911 is supported on a supporting member 915. A heater 912 is disposed within the hollow of the fixing film 911 and is fixedly attached to the supporting member 915. A temperature sensor 913 is mounted on the heater 912, for detecting the temperature of the heater 912.

The pressure roller 914 is urged by a predetermined pressing force against the heater 912 such that the fixing film 911 is sandwiched between the pressure roller 914 and the heater 912, and a nip N is formed between the pressure roller 914 and the fixing film 911 so as to nip and convey a transfer material P carrying an unfixed toner image t formed thereon. The pressure roller 914 is driven by a drive motor (not shown) for rotation in a direction indicated by an arrow in FIG. 14, and the rotation of the pressure roller 914 causes rotation of the fixing film 911 such that the inner surface of the fixing film 911 is moved in sliding contact with the lower surface of the heater 912 while being guided by the supporting member 915.

The unfixed toner image t is heated and pressed while the transfer material P carrying the same is passing through the nip N, and is fixed on the transfer material P.

The fixing film 911 is formed of a heat-resistant resin endless film, for example, which has a thickness of approximately 500 μm, and has a surface on which is formed a release layer (e.g. a fluorocarbon resin coating layer) having a thickness of approximately 10 μm. The fixing film 911 has no elastic layer formed thereon, so as to reduce the heat capacity of the same.

The heater 912 is comprised of a ceramic substrate and a resistive heater element formed on the ceramic substrate. A temperature detected by a temperature sensor 913 mounted on the heater 912 is input to a controller (not shown). The controller performs temperature adjustment control for adjusting the temperature of the nip N to the fixable temperature, based on the temperature detected by the temperature sensor 913. More specifically, the temperature of the heater 912 (i.e. energization of the heater 912) is controlled.

In the fixing device constructed as above, since the heat capacity of the fixing film 911 is set to a very small value, it is possible to raise the temperature of the nip N to the fixable temperature in a short time after the heater 912 is energized.

However, the fixing device using the fixing film 911 having no elastic layer is not suitable for a color image forming apparatus. When the fixing film 911 having no elastic layer is used, the surface thereof cannot come into intimate contact with recessed portions formed on the transfer material due to unevenness of the surface of the transfer material, irregularities caused by the presence/absence of a toner layer, and unevenness of a toner layer. As a consequence, the amount of heat applied to the surface of the transfer material via the fixing film 911 differs between projecting portions and recessed portions on the transfer material. More specifically, since the projecting portions come into intimate contact with the fixing film 911, the amount of heat transferred to the projecting portions from the fixing film 911 is larger than that of heat transferred to the recessed portions.

A color image is formed by superimposing toner layers of a plurality of colors one upon another, and hence unevenness of the color toner layer of the color image thus formed is larger than that of the monochrome toner layer of a monochrome image. Therefore, when the fixing film has no elastic layer, gloss unevenness of the fixed image is increased, which causes degradation of image quality. Further, when an image is formed on an OHP sheet, transmissivity of light through the OHP sheet used for projection is degraded, which is likely to cause degradation of image quality.

To solve this problem, there has been proposed a fixing device using a fixing belt (fixing film) formed with an elastic layer (see Japanese Patent Laid-Open publication (Kokai) No. 11-15303).

However, a material, such as silicone rubber, used to form the elastic layer of the fixing belt, has a high thermal conductivity and is easily deformed. As a consequence, if the fixing belt is left under pressure for a long time, the elastic layer does not sometimes return to its original state from the deformed state during a warm-up time period before the start of printing, which prevents a proper amount of heat from being transferred from the fixing belt to a toner image on a sheet. This causes a change in the surface reflectivity of a fixed image, leading to degradation of image quality.

Further, in order to prolong the service life of the fixing belt, it is required to provide an unpressurizing mechanism for automatically stopping the application of pressure to the fixing belt when the image forming apparatus enters an energy-saving mode or when the power of the same is turned off. The unpressurizing mechanism separates the fixing belt from the pressure roller to thereby stop the application of pressure to the fixing belt.

However, if the heater is energized when the fixing belt is in an unpressurized state due to occurrence of some abnormality, heat is not transferred to the pressure roller, and hence the temperature of the elastic layer of the fixing belt rises sharply. As a consequence, the heat damages the elastic layer, which leads to reduction of the service life of the fixing belt. Further, the sharp rise in the temperature of the heater can cause the breakage of the heater.

To solve this problem, there has been proposed a fixing device including a power cut-off circuit configured to detect an unpressurized state of a fixing belt and forcibly cut off supply of electric power to a heater (see Japanese Patent Laid-Open publication (Kokai) No. 2005-321511).

However, in the fixing device having the power cut-off circuit, even though the fixing belt is in the unpressurized state in actuality, this state of the fixing belt is sometimes not detected due to occurrence of some abnormality. In such a case, forcible interruption of supply of electric power is not executed by the power cut-off circuit despite the unpressurized state of the fixing belt. If electric power is supplied to the heater in such a state, damage is caused to the fixing belt and the heater.

SUMMARY OF THE INVENTION

The present invention provides an image forming apparatus, a method of controlling a fixing device, and a device and method for detecting abnormality of the fixing device, which are capable of detecting occurrence of an abnormality that a fixing member actually in an unpressurized state is detected to be in a pressurized state, allowing electric power to be supplied to a heating member.

In a first aspect of the present invention, there is provided an image forming apparatus comprising a fixing device configured to fix an image on a transfer material, the fixing device including a first fixing member for being heated by a heating member, and a second fixing member, wherein the first fixing member and the second fixing member are pressed against each other such that a nip is formed between the first fixing member and the second fixing member, for nipping the transfer material to convey the transfer material through the nip while heating and pressing the transfer material, a pressurizing unit configured to be selectively switched between a pressurizing state for causing the first fixing member and the second fixing member to be pressed against each other and an unpressurizing state in which the pressurizing state is released, a pressurizing state-detecting unit configured to detect whether or not the pressurizing unit is in the pressurizing state, a temperature-detecting unit configured to detect a change in temperature caused by heating by the heating member, and a control unit configured to cause the heating member to heat the first fixing member when it is detected by the pressurizing state-detecting unit that the pressurizing unit is in the pressurizing state, and cause the heating member to stop heating the first fixing member, based on a result of detection by the temperature-detecting unit after a lapse of a predetermined time period from start of the heating of the first fixing member by the heating member.

With the arrangement of the first aspect of the present invention, it is possible to detect occurrence of an abnormality that the fixing member actually in an unpressurized state is detected to be in a pressurized state, allowing electric power to be supplied to the heating member. This makes it possible to prevent the fixing member and the heating member from being damaged due to supply of electric power to the heating member when the fixing member is in the unpressurized state.

In a second aspect of the present invention, there is provided an image forming apparatus comprising a fixing device configured to fix an image on a transfer material, the fixing device including a first fixing member for being heated by a heating member, and a second fixing member, wherein the first fixing member and the second fixing member are pressed against each other such that a nip is formed between the first fixing member and the second fixing member, for nipping the transfer material to convey the transfer material through the nip while heating and pressing the transfer material, a pressurizing unit configured to be selectively switched between a pressurizing state for causing the first fixing member and the second fixing member to be pressed against each other and an unpressurizing state in which the pressurizing state is released, a pressurizing state-detecting unit configured to detect whether or not the pressurizing unit is in the pressurizing state, a temperature-detecting unit configured to detect a change in temperature caused by heating by the heating member, and a determination unit configured to determine, when it is detected by the pressurizing state-detecting unit that the pressurizing unit is in the pressurizing state, whether or not the first fixing member and the second fixing member are in a pressurized state in which the first fixing member and the second fixing member are pressed against each other, based on a result of detection by the temperature-detecting unit after a lapse of a predetermined time period from start of the heating of the first fixing member by the heating member.

In a third aspect of the present invention, there is provided a method of controlling a fixing device including a first fixing member for being heated by a heating member, a second fixing member pressed against the first fixing member such that a nip is formed between the first fixing member and the second fixing member, for nipping the transfer material to convey the transfer material through the nip while heating and pressing the transfer material, and a pressurizing unit configured to be selectively switched between a pressurizing state for causing the first fixing member and the second fixing member to be pressed against each other and an unpressurizing state in which the pressurizing state is released, the method comprising a pressurizing state-detecting step of detecting whether or not the pressurizing unit is in the pressurizing state, a heating step of causing the heating member to heat the first fixing member when it is detected in the pressurized state-detecting step that the pressurizing unit is in the pressurizing state, a temperature-detecting step of detecting a change in temperature caused by heating by the heating member, after a lapse of a predetermined time period from start of the heating of the first fixing member by the heating member, and a heating stop step of stopping the heating of the first fixing member by the heating member based on a result of detection in the temperature-detecting step.

In a fourth aspect of the present invention, there is provided a method of determining abnormality of a fixing device of an image forming apparatus including the fixing device configured to fix an image on a transfer material, the fixing device including a first fixing member for being heated by a heating member, and a second fixing member, wherein the first fixing member and the second fixing member are pressed against each other such that a nip is formed between the first fixing member and the second fixing member, for nipping the transfer material to convey the transfer material through the nip while heating and pressing the transfer material, and a pressurizing unit configured to be selectively switched between a pressurizing state for causing the first fixing member and the second fixing member to be pressed against each other and an unpressurizing state in which the pressurizing state is released, the method comprising a pressurizing state-detecting step of detecting whether or not the pressurizing unit is in the pressurizing state, a temperature-detecting step of detecting a change in temperature caused by heating by the heating member, and a determination step of determining, when it is detected in the pressurizing state-detecting step that the pressurizing unit is in the pressurizing state, whether or not the first fixing member and the second fixing member are in a pressurized state in which the first fixing member and the second fixing member are pressed against each other, based on a result of detection in the temperature-detecting step after a lapse of a predetermined time period from a start of the heating of the first fixing member by the heating member.

The features and advantages of the invention will become more apparent from the following detailed description taken in conjunction with the accompanying drawings.

DETAILED DESCRIPTION OF THE EMBODIMENTS

The present invention will now be described in detail with reference to the drawings showing preferred embodiments thereof.

Figure 1:
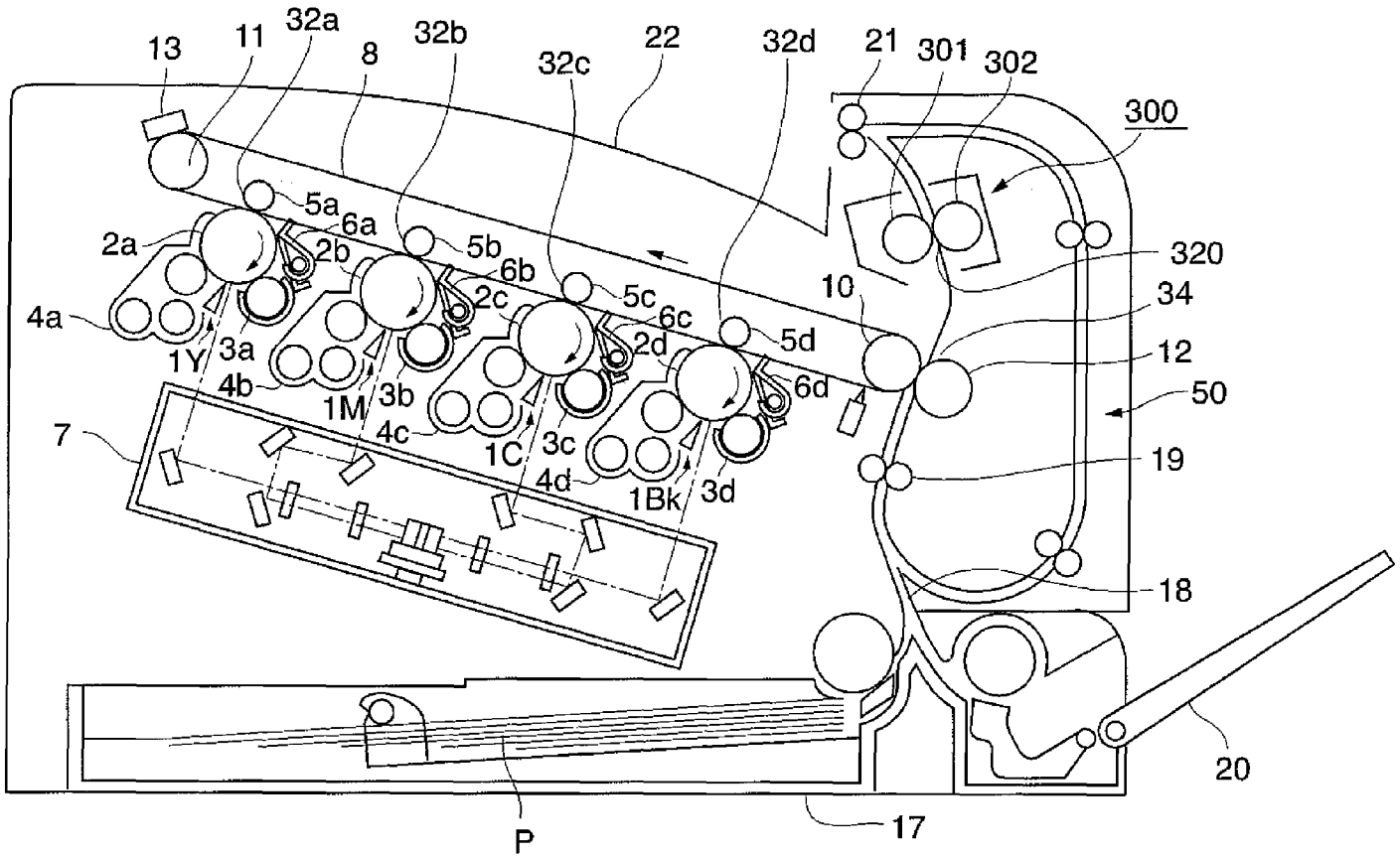
FIG. 1 is a longitudinal cross-sectional view of an image forming apparatus according to a first embodiment of the present invention.

FIG. 1 is a longitudinal cross-sectional view of an image forming apparatus according to a first embodiment of the present invention. In the present embodiment, an electrophotographic color image forming apparatus using a tandem intermediate transfer belt (intermediate transfer unit) will be described as an image forming apparatus.

As shown in FIG. 1, the color image forming apparatus has an image forming unit for forming images in respective colors, i.e. yellow (Y), magenta (M), cyan (C), and black (Bk).

The image forming unit includes an image forming section 1Y for forming a yellow (Y) image, an image forming section 1M for forming a magenta (M) image, an image forming section 1C for forming a cyan (C) image, and an image forming section 1Bk for forming a black (Bk) image. These four image forming sections 1Y, 1M, 1C, and 1Bk are arranged in a row at predetermined space intervals.

The image forming sections 1Y, 1M, 1C, and 1Bk have respective photosensitive drums 2*a*, 2*b*, 2*c*, and 2*d*. Around the photosensitive drums 2*a* to 2*d*, there are arranged primary electrostatic chargers 3*a*, 3*b*, 3*c*, and 3*d*, developing devices 4*a*, 4*b*, 4*c*, and 4*d*, transfer rollers 5*a*, 5*b*, 5*c*, and 5*d*, and drum cleaners 6*a*, 6*b*, 6*c*, and 6*d*, respectively. Further, there is disposed a laser exposure device 7 for performing exposure scanning of the photosensitive drums 2*a* to 2*d* by irradiating these with laser light.

Each of the photosensitive drums 2*a* to 2*d* is a negatively charged OPC photoreceptor, and is formed by an aluminum drum substrate having a photoconductive layer formed on a surface thereof. The photosensitive drums 2*a* to 2*d* are each driven by a driving device (not shown) to perform clockwise rotation at a predetermined processing speed. Each of the primary electrostatic chargers 3*a* to 3*d* uniformly charges the surface of an associated one of the photosensitive drums 2*a* to 2*d* to a predetermined negative potential by a charge bias applied from a charge bias power source (not shown).

The laser exposure device 7 includes a laser light-emitting section for emitting light based on input image information, a polygon lens, and a reflective mirror, and performs exposure scanning of the photosensitive drums 2*a* to 2*d*. As a consequence, electrostatic latent images for the respective colors are formed according to the image information on the respective surfaces of the photosensitive drums 2*a* to 2*d* charged by the respective associated primary electrostatic chargers 3*a* to 3*d*.

Each of the developing devices 4*a* to 4*d* contains toner of an associated color, i.e. an associated one of a yellow toner, a cyan toner, a magenta toner, and a black toner, and supplies the toner to an associated one of the photosensitive drums 2*a* to 2*d*. An electrostatic latent image formed on the associated one of the photosensitive drums 2*a* to 2*d* is developed (visualized) as a toner image in the associated color by the supplied toner.

Each of the transfer rollers 5*a* to 5*d* is disposed in an associated one of primary transfer sections 32*a*, 32*b*, 32*c*, and 32*d* in a manner pressed against an associated one of the photosensitive drums 2*a* to 2*d* via an intermediate transfer belt 8. The toner images on the respective photosensitive drums 2*a* to 2*d* are sequentially transferred by the respective associated transfer rollers 5*a* to 5*d* onto the intermediate transfer belt 8 in superimposed relation at the respective primary transfer sections 32*a*, 32*b*, 32*c*, and 32*d*.

The intermediate transfer belt 8 is disposed above the photosensitive drums 2*a* to 2*d* in a manner stretched between a secondary-transfer opposed roller 10 and a tension roller 11. The secondary-transfer opposed roller 10 is disposed in a secondary transfer section 34 in a manner pressed against a secondary-transfer roller 12 via the intermediate transfer belt 8. The intermediate transfer belt 8 is formed of a dielectric resin, such as a polycarbonate resin film, a polyethylene terephthalate resin film, or a polyvinylidene fluoride resin film.

The toner image transferred onto the intermediate transfer belt 8 is transferred onto a transfer material P fed from a sheet feeder unit, described hereinafter, at the secondary transfer section 34. In the vicinity of the tension roller 11, there is disposed a belt cleaner 13 for removing toner remaining on the surface of the intermediate transfer belt 8 and collecting the removed toner.

Each of the drum cleaners 6*a* to 6*d* has a cleaning blade (not shown), and uses the cleaning blade to scrape off toner remaining on the surface of an associated one of the photosensitive drums 2*a* to 2*d* and collect the removed toner.

The sheet feeder unit includes a sheet feed cassette 17 and a manual feed tray 20. The sheet feed cassette 17 contains transfer materials P as a bundle, and the transfer materials P are sequentially fed one by one by a pickup roller (not shown). When a transfer material P fed from the sheet feed cassette 17 reaches a registration roller pair 19 via a feed roller and a feed guide 18, the transfer material P is temporarily stopped, and then is conveyed to the secondary transfer section 34 by the registration roller pair 19 in timing synchronous with image forming operation.

The manual feed tray 20 is for feeding transfer materials P manually one by one, and a transfer material P placed on the manual feed tray 20 is fed toward the registration roller pair 19 similarly to the feed of a transfer material P from the sheet feed cassette 17.

A transfer material P having a toner image transferred thereon at the secondary transfer section 34 is conveyed to a fixing device 300. The fixing device 300 is comprised of a fixing belt (first fixing member) 301 and a pressure roller (second fixing member) 302. The fixing belt 301 and the pressure roller 302 are pressed against each other by a predetermined pressure, and a nip 320 is formed between the fixing belt 301 and the pressure roller 302, for nipping and conveying the transfer material P. While being nipped and conveyed through the nip 320, the transfer material P is heated and pressed, whereby the toner image on the transfer material P is fixed on the same as a fixed image. The configuration of the fixing device 300 will be described in detail hereinafter.

The transfer material P having passed through the fixing device 300 is discharged onto a discharge tray 22 by a discharge roller pair 21.

Figure 2:
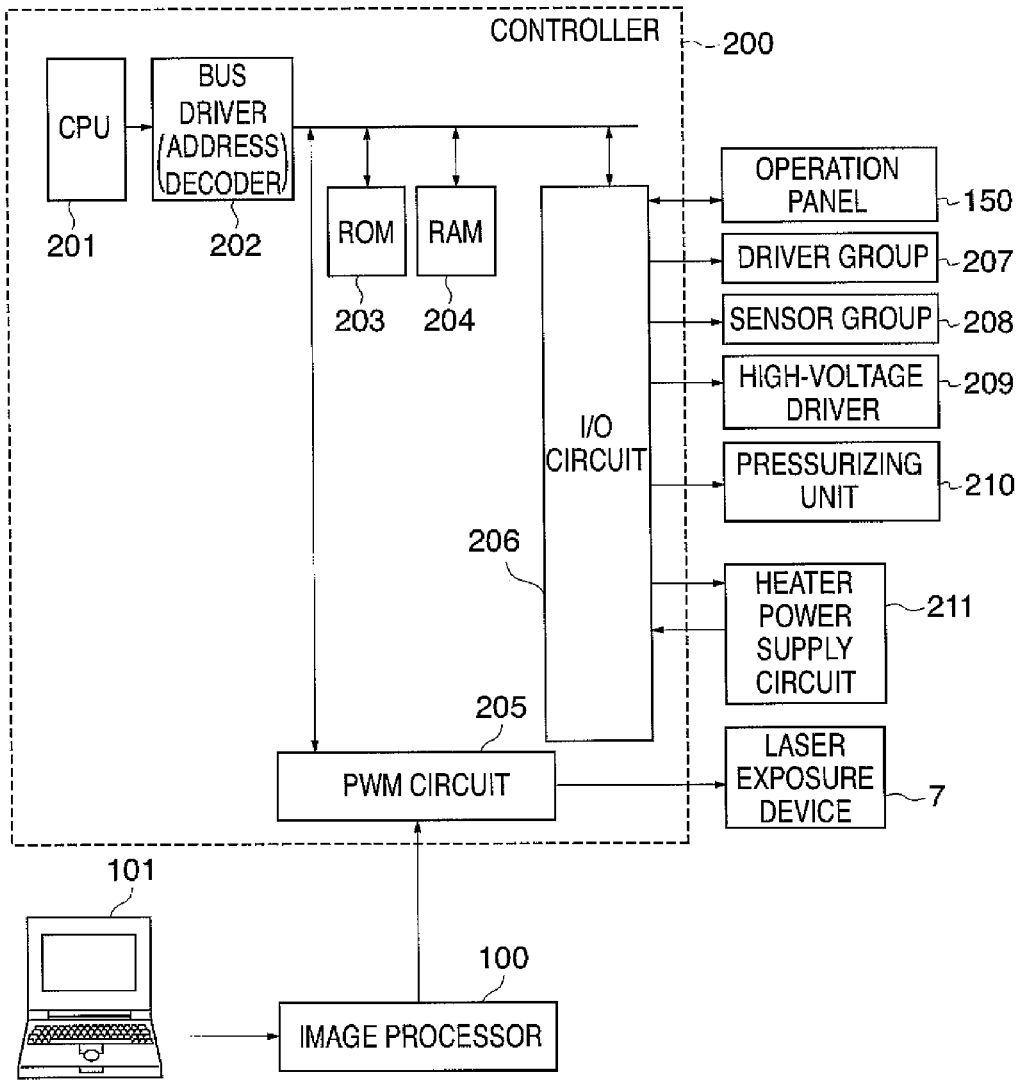
FIG. 2 is a block diagram showing an electrical configuration of the image forming apparatus in FIG. 1.

Next, the control configuration of the image forming apparatus according to the present embodiment will be described with reference to FIG. 2. FIG. 2 is a block diagram showing the electrical configuration of the image forming apparatus in FIG. 1.

As shown in FIG. 2, the image forming apparatus according to the present embodiment includes a controller (control unit) 200 for controlling the overall operation of the image forming apparatus and executing individual processes using respective associated sections and components of the image forming apparatus.

The controller 200 is comprised of a CPU 201, a bus driver 202 including an address decoder, a ROM 203, a RAM 204, an I/O circuit 206, and a PWM circuit 205. The CPU 201 reads out and executes programs stored in the ROM 203 to thereby control the overall operation of the image forming apparatus and carry out individual processes using respective associated sections and components of the image forming apparatus. In these operations, the RAM 204 is used as a work area for the CPU 201.

The I/O circuit 206 serves as an interface for controlling the inputting and outputting of signals to and from an operation panel 150, a driver group 207, a sensor group 208, a high-voltage driver 209, a pressurizing unit 210, and a heater power supply circuit 211.

The operation panel 150 is comprised of various kinds of keys (not shown) for entering numerical values and setting modes, and a display (not shown) for displaying the status of the apparatus, settings of the currently set mode, error information, and so forth.

The driver group 207 includes various kinds of drivers, such as motor drivers for driving motors of feed rollers, conveying rollers, the pressure roller of the fixing device 300, and so forth, and drivers for driving clutches, solenoids, and the like. Each of the various drivers included in the driver group 207 drives an associated one of the motors, the clutches, and the solenoids based on a control signal from the CPU 201.

The sensor group 208 includes various kinds of sensors, such as sheet-detecting sensors for detecting the presence/absence of transfer materials P on a conveying path, and toner sensors for detecting the amounts of toner in the respective developing devices 4*a* to 4*d*. Further, the sensor group 208 includes position sensors for detecting home positions of respective loads, such as motors, and sensors for detecting the opening/closing of a door, and the like. An output from each of the various sensors included in the sensor group 208 is input to the CPU 201 via the I/O circuit 206.

The high-voltage driver 209 generates various kinds of high voltages, such as charge biases of the respective primary electrostatic chargers 3*a* to 3*d*, developing biases of the developing devices 4*a* to 4*d*, and transfer voltages of the transfer rollers 5*a* to 5*d*, based on control signals from the CPU 201.

The pressurizing unit 210 is a mechanism configured to be selectively switched between a pressuring state for causing the fixing belt 301 and the pressure roller 302 of the fixing device 300 to be pressed against each other by a predetermined pressing force and an unpressurized state for releasing the pressurizing state. The configuration of the pressurizing unit 210 will be described in detail hereinafter.

The heater power supply circuit 211 drives a heater provided in the fixing device 300. The configuration of the heater power supply circuit 211 will be described in detail hereinafter.

The PWM circuit 205 generates a PWM (Plus Width Modulation) signal as a drive signal for driving the laser exposure device 7, based on image data input from an image processor 100, and outputs the PWM signal to the laser exposure device 7.

The image processor 100 converts data input e.g. from a PC (Personal Computer) 101 into image data, and outputs the image data to the PWM circuit 205.

Although in the image forming apparatus according to the present embodiment, the image forming sections 1Y, 1M, 1C, and 1Bk are arranged in the mentioned order from upstream to downstream in the direction of rotation of the intermediate transfer belt 8, this is not limitative.

Figure 3:
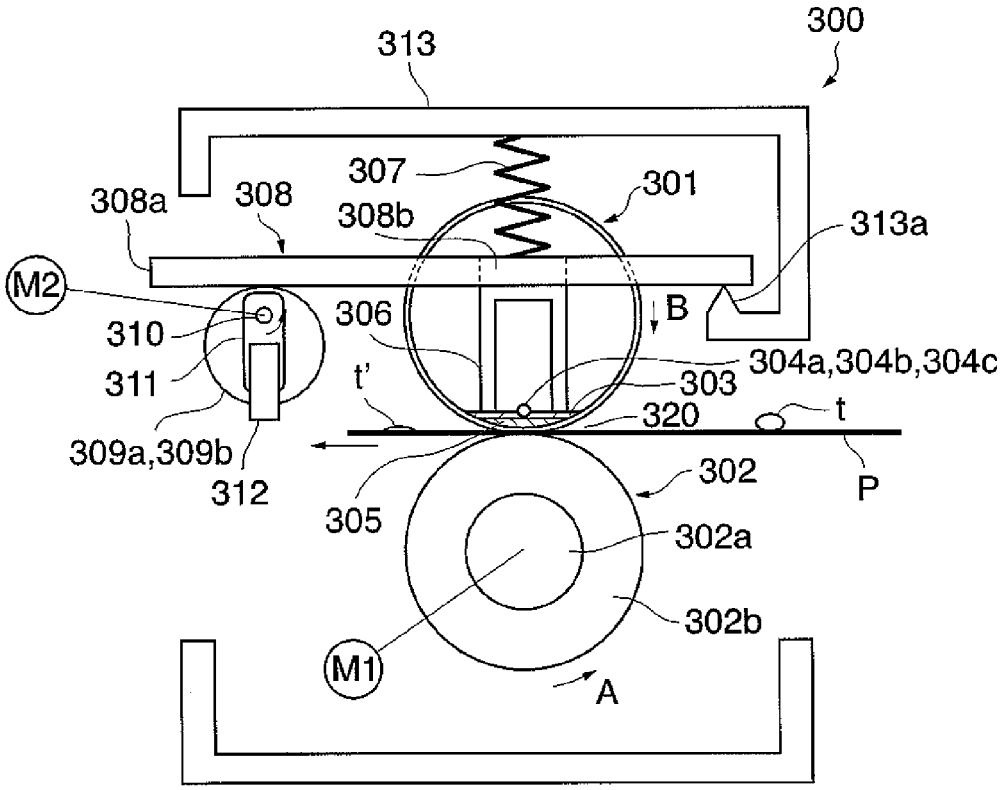
FIG. 3 is a longitudinal cross-sectional view of a fixing device appearing in FIG. 1.
Figure 4:
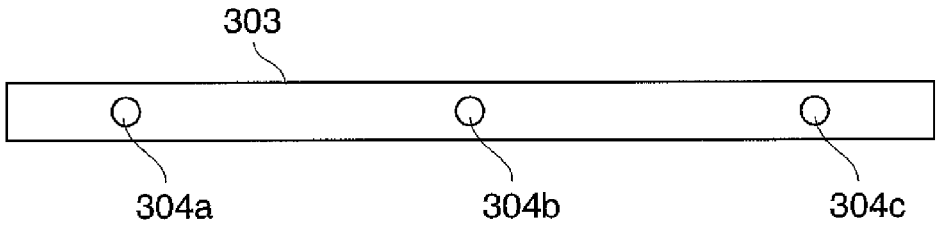
FIG. 4 is a plan view of a heater holder on which are arranged thermistors appearing in FIG. 3.
Figure 5:
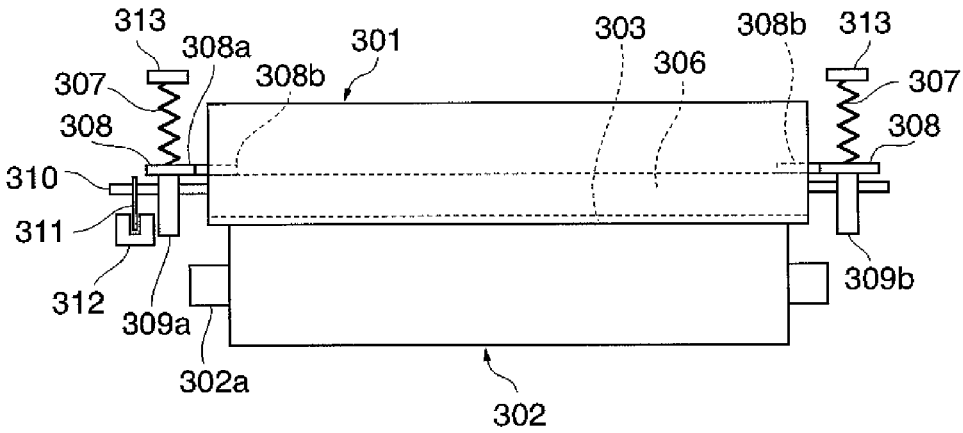
FIG. 5 is a view showing a fixing belt and a pressure roller in a pressurized state in the fixing device appearing in FIG. 1.
Figure 6:
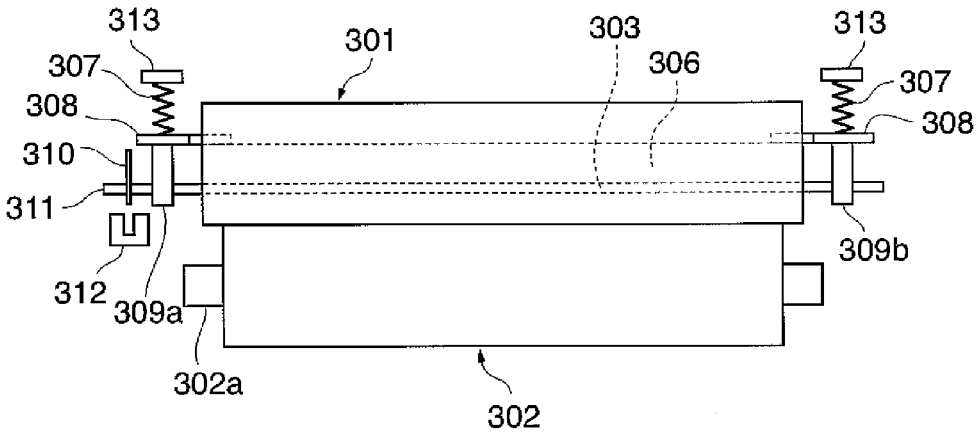
FIG. 6 is a view showing the fixing belt and the pressure roller in an unpressurized state in the fixing device appearing in FIG. 1.

Next, the fixing device 300 and the pressurizing unit 210 will be described in detail with reference to FIGS. 3 to 6. FIG. 3 is a longitudinal cross-sectional view of the fixing device 300 appearing in FIG. 1. FIG. 4 is a plan view of a heater holder 303 on which are arranged thermistors 304*a* to 304*c* appearing in FIG. 3. FIG. 5 is a view showing the fixing belt 301 and the pressure roller 302 in the pressurized state in the fixing device 300 appearing in FIG. 1. FIG. 6 is a view showing the fixing belt 301 and the pressure roller 302 in the unpressurized state in the fixing device 300 appearing in FIG. 1.

As shown in FIG. 3, the fixing device 300 has the fixing belt 301 and the pressure roller 302 accommodated in a frame 313. The fixing belt 301 is formed by a hollow cylindrical (endless belt-shaped) film member (formed e.g. of a polyimide resin) having a thickness of 50 μm. The fixing belt 301 has a silicone rubber layer formed on a surface thereof, for serving as an elastic layer, and the silicone rubber layer is coated with a PFA resin tube having a thickness of 30 μm.

The silicone rubber layer is thus formed of a material having a highest possible thermal conductivity, whereby the heat capacity of the fixing belt 301 is minimized.

This is desirable from the viewpoint of reducing the rise time of the temperature of the fixing belt 301. For example, a silicone rubber layer having a thermal conductivity of $4.19\times 10^{-3}$ J/sec·cm·K is formed. Further, from the viewpoint of image quality, such as transmissivity of an image on an OHP sheet and occurrence of minute gloss unevenness on an image, it is desirable to maximize the thickness of the silicone rubber layer of the fixing belt 301, and hence the thickness of the silicone rubber layer is set to 200 μm or more, e.g. 250 μm. Further, by forming a fluorocarbon resin layer on the surface of the fixing belt 301, it is possible to improve releasability of the surface of the fixing belt 301. In this case, it is possible to prevent occurrence of an offset phenomenon that toner once having adhered to the surface of the fixing belt 301 is transferred again onto a transfer material P. Further, by forming the fluorocarbon resin layer on the surface of the fixing belt 301 into a PFA resin tube, it is possible to form a uniform fluorocarbon resin layer more easily.

The pressure roller 302 is comprised of a core metal part 302*a* and a rubber part 302*b* formed in a manner covering the core metal part 302*a*. The core metal part 302*a* is rotatably supported on the frame 313, and is rotated by the driving force of a motor M1 in a direction indicated by an arrow A in FIG. 3. The core metal part 302*a* is formed e.g. of a stainless material. The rubber part 302*b* is formed by a silicone rubber layer having a thickness of approximately 3 mm, and has a surface thereof coated with a PFA resin tube having a thickness of approximately 40 μm.

The heater holder 303 is disposed in the fixing belt 301 to act as a guide member when the fixing belt 301 rotates in a manner driven by rotation of the pressure roller 302. The heater holder 303 extends in the longitudinal direction of the fixing belt 301, and is formed by a heat-resistant and rigid member having a trough shape in transverse cross section. The heater holder 303 is formed e.g. of a liquid crystal polymer resin. As the liquid crystal polymer resin, ZENITE 7755 (trade name) produced by DuPont is used, for example. A maximum temperature allowing the use of the ZENITE 7755 is approximately 543 K.

The heater holder 303 holds a heater (heating member) 305 extending in the longitudinal direction of the heater holder 303. The heater 305 is implemented by a ceramic heater, and is disposed on the lower surface of the heater holder 303. Specifically, the heater 305 is comprised of a resistive heater layer formed by coating an aluminum oxide (alumina) or aluminum nitride substrate with a conductive paste containing silver palladium alloy such that the conductive paste forms a film having a uniform thickness. The resistive heater layer has a thickness of approximately 10 μm and a width of 1 to 5 mm. The resistive heater layer is glass-coated with a pressure-resistant glass capable of withstanding sliding friction with the fixing belt 301 and having a thickness of approximately 10 μm.

As shown in FIG. 4, a plurality of thermistors (temperature detecting unit) 304*a*, 304*b*, and 304*c* are arranged on the heater holder 303 at different locations along the longitudinal direction of the same, each for detecting a temperature dependent on heating of the heater 305. It should be noted that the longitudinal direction of the heater holder 303 is orthogonal to a direction of conveying the transfer material P. In the present embodiment, the three thermistors 304*a* to 304*c* are arranged at equal space intervals, and the thermistor 304*b* is disposed in a central part of the heater holder 303 in the longitudinal direction of the same. The number of thermistors and the arrangement thereof is not limited to the above. Instead of detecting temperature of the heater 306, the heater holder 303 may be disposed in contact with the fixing belt 301, whereby the temperature of the fixing belt 301 may be detected.

A pressurizing stay 306 having a portal shape in transverse cross section is mounted on the heater holder 303. As shown in FIGS. 3 to 5, unpressurizing stays 308 are fixedly attached to the opposite ends of the pressurizing stay 306, respectively. Each of the unpressurizing stays 308 is comprised of an arm 308*a* extending in a direction orthogonal to the longitudinal direction of the fixing belt 301, and a fixed part 308*b* protruding from the arm 308*a*. The fixed part 308*b* is fixed to the associated end of the pressurizing stay 306.

Spring members 307 are disposed between the arms 308*a* of the respective unpressurizing stays 308 and the frame 313. Each spring member 307 urges the associated arm 308*a* by its resilient force. That is, the resilient forces of the spring members 307 acting on the respective unpressurizing stays 308 urge the heater holder 303 (heater 305) against the fixing belt 301 via the unpressurizing stays 308, and the fixing belt 301 is pressed against the pressure roller 302 by a predetermined pressing force. In other words, the spring members 307 apply pressure to the fixing belt 301 such that the fixing belt 301 is pressed against the pressure roller 302 together with the heater 305 by the predetermined pressing force. The pressing force of each of the spring members 307 is set to 98 N (10 kgf), so that the spring members 307 can have a total pressing force of 196 N (20 kgf).

When the fixing belt 301 is thus pressed against the pressure roller 302 by the predetermined pressing force, the silicone rubber layer of the fixing belt 301 and the silicone rubber layer of the pressure roller 302 are brought into pressure contact with each other in an elastically deformed state. As a consequence, a nip 320 with a predetermined width, which is required for a heating and fixing operation, is formed between the fixing belt 301 and the pressure roller 302.

The arm 308*a* of each of the unpressurizing stays 308 has one end thereof swingably supported by a supporting portion 313*a* of the frame 313 and the other end thereof held in contact with an associated one of cams 309*a* and 309*b*. The cams 309*a* and 309*b* are eccentric cams fixed to a drive shaft 310. The drive shaft 310 is driven for rotation by a motor M2 such that the cams 309*a* and 309*b* rotate about the drive shaft 310 within a predetermined angle range. As the cams 309*a* and 309*b* rotate, the arms 308*a*, i.e. the unpressurizing stays 308 swing about the supporting portion 313*a* of the frame 313 against the resilient forces of the respective spring members 307. As a consequence, pressurization of the fixing belt 301 by the spring members 307 is released, and the fixing belt 301 and the pressure roller 302 are released from the state pressed against each other.

A flag member (linkage member) 311 is fixedly attached to one end of the drive shaft 310, and the status of rotation of the flag member 311 about the drive shaft 310 is detected by a photosensor 312. A detection signal output from the photosensor 312 is used to detect whether the pressurizing unit 210 is in the pressurizing state in which the fixing belt 301 is pressurized by the spring members 307 or in the unpressurized state in which the pressurized state is released.

Specifically, when the flag member 311 is in a position (first reference position) for blocking an optical path formed by the photosensor 312, the photosensor 312 outputs a detection signal indicating that the pressurizing unit 210 is in the pressurizing state for causing the fixing belt 301 to be pressurized by the spring members 307. On the other hand, when the flag member 311 moves from the first reference position to a position (second reference position) for opening the optical path of the photosensor 312, the photosensor 312 outputs a detection signal indicating that the pressurizing unit 201 is in the unpressurized state in which the pressurized state is released.

Thus, the spring members 307, the pressurizing stays 306, the unpressurizing stays 308, the cams 309*a* and 309*b*, the motor M2, and the controller 200 cooperate with each other to form the pressurizing unit 210, and the controller 200 controls the motor M2 based on the detection signal from the photosensor 312 to control the rotation of the cams 309*a* and 309*b*.

In the pressurizing unit 210, so long as a state where the cam 309*a* (i.e. the flag member-side cam) rests in a rotational angular position corresponding to the first reference position is maintained, the fixing belt 301 is held in the state pressurized by the spring members 307 (see FIG. 5). In the case of releasing the fixing belt 301 from the pressurization by the spring members 307, the cams 309*a* and 309*b* are rotated until the flag member 311 is moved from the first reference position to the second reference position (see FIG. 6). Inversely, to return the fixing belt 301 from the unpressurized state (FIG. 6) to the pressurized state (FIG. 5), the cams 309*a* and 309*b* are rotated until the flag member 311 is returned from the second reference position to the first reference position.

Figure 7:
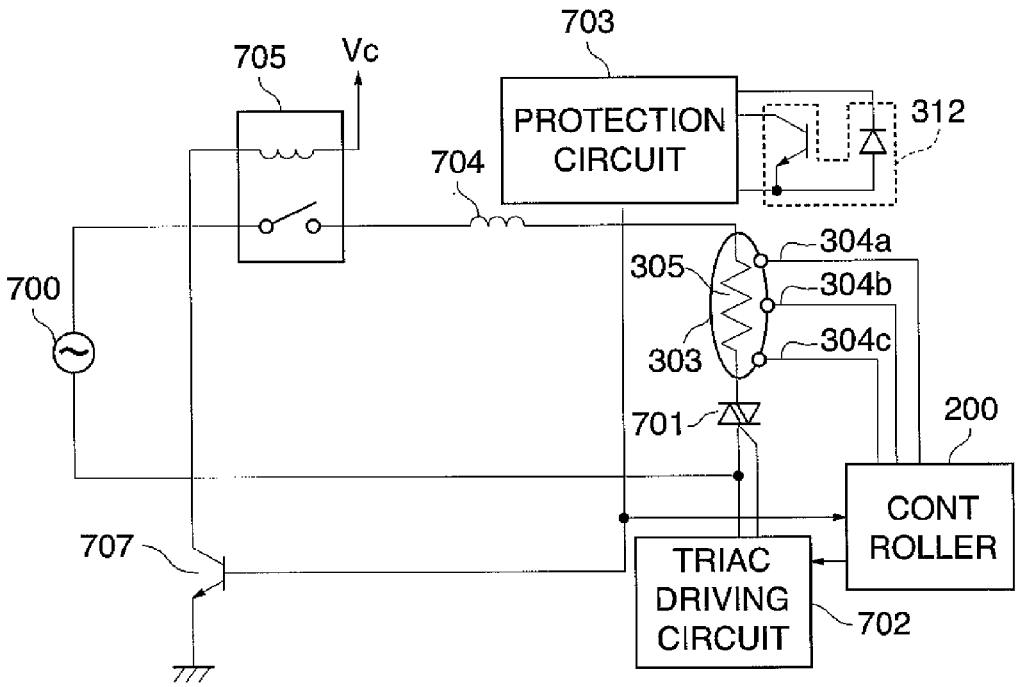
FIG. 7 is a circuit diagram of a heater power supply circuit appearing in FIG. 2.

Next, the configuration of the heater power supply circuit 211 for supplying electric power to the heater 305 will be described with reference to FIG. 7. FIG. 7 is a circuit diagram of the heater power supply circuit 211 appearing in FIG. 2.

As shown in FIG. 7, the heater power supply circuit 211 has an AC power supply (commercial AC power supply) 700 as a power supply for driving the heater 305, and supplies AC electric power to the heater 305. The heater power supply circuit 211 is comprised of a triac 701 for supplying electric power to the heater 305, a triac driving circuit 702 for turning on and off the triac 701 in response to a control signal from the controller 200, a protection circuit 703, and a relay 705.

The controller 200 outputs the control signal for turning on/off the triac 701 to the triac driving circuit 702 according to a temperature detected by the thermistors 304*a* to 304*d*. The triac driving circuit 702 causes the triac 701 to turn on in response to the control signal, whereby the temperature of the heater 305 is controlled.

When the fixing belt 301 is pressurized, the optical path of the photosensor 312 is blocked by the flag member 311, as described hereinabove, and the photosensor 312 delivers to the protection circuit 703 the detection signal indicating that the fixing belt 301 is in the pressurized state. In response to the detection signal, the protection circuit 703 turns on a transistor 707. This causes the relay 705 to turn on to make electrically continuous a power supply path extending from the AC power supply 700 to the heater 305 via a line filter 704. In short, energization of the heater 305 is enabled. The relay 705 is connected to a power supply Vc. The power supply Vc is a 24 V DC power supply of the same type as power supplies for the motors and the high-voltage power supply of the main unit of the apparatus.

On the other hand, when the fixing belt 301 is released from pressure, the optical path of the photosensor 312 is opened by the flag member 311, and the photosensor 312 delivers to the protection circuit 703 the detection signal indicating that the pressuring unit 210 is in the unpressurizing state for causing the fixing belt 301 to be unpressurized. In response to the detection signal, the protection circuit 703 turns off the transistor 707. This causes the relay 705 to turn off to make electrically discontinuous the power supply path extending from the AC power supply 700 to the heater 305. In short, energization of the heater 305 is disabled, whereby heating of the fixing belt 301 is stopped.

The protection circuit 703, the relay 705, and the transistor 707 thus cooperate with each other to form a protection unit for cutting off the supply of electric power to the heater 305 when it is detected that the pressurizing unit 210 is in the unpressurizing state for causing the fixing belt 301 to be unpressured.

Further, if the fixing belt 301 is in the unpressurized state, energization of the heater 305 is forcibly disabled. This makes it possible to disable energization of the heater 305 even if the control signal for turning on the triac 701 is erroneously output from the controller 200. That is, the protection circuit 703 is configured to be capable of disabling energization of the heater 305 independently of the operation of the controller 200 for controlling the temperature of the heater 305.

The detection signal from the photosensor 312 is input to the controller 200 via the protection circuit 703. The controller 200 recognizes, based on the detection signal received from the photosensor 312, whether the pressurizing unit 210 is in the pressurizing state for causing the fixing belt 301 to be pressurized or in the unpressurizing state for unpressurizing the fixing belt 301.

During a printing operation, the pressurizing unit 210 operates to apply pressure to the fixing belt 301 by the spring members 307, and the fixing belt 301 is held in the state pressed against the pressure roller 302 by the predetermined pressing force. The pressure roller 302 is driven by the motor M1 to rotate at a predetermined circumferential speed in the direction (counterclockwise direction) indicated by the arrow A in FIG. 3. In accordance with the rotation of the pressure roller 302, the fixing belt 301 rotates in a direction (clockwise direction) indicated by an arrow B in FIG. 3, while being guided by the heater holder 303. During this rotation, the inner surface of the fixing belt 301 moves in intimate sliding contact with the heater holder 303 and the heater 305. The inner surface of the fixing belt 301 is coated with grease so as to maintain slidability with respect to the heater holder 303 and the heater 305.

Further, the heater 305 is energized by the heater power supply circuit 211, and the fixing belt 301 is heated. Then, temperature control is performed by the controller 200 such that the temperature of the nip 320 becomes a predetermined temperature (fixable temperature).

Thereafter, the transfer material P carrying an unfixed toner image t is conveyed to the nip 320 formed between the fixing belt 301 and the pressure roller 302. Upon reaching the nip 320, the transfer material P is nipped and conveyed with the toner image carrying surface thereof held in intimate contact with the outer surface of the fixing belt 301, and is passed through the nip 320. During this operation, the unfixed toner image t on the transfer material P is heated and pressed, as shown in FIG. 3, and is fixed as a fixed image t' on the transfer material P.

When a predetermined time period has elapsed after completion of the printing operation, energization of the heater 305 is stopped by the heater power supply circuit 211. Further, the pressurizing unit 210 pressurizes the fixing belt 301. In doing this, as described hereinabove, the relay 705 turns off, whereby supply of electric energy to the heater 305 is cut off.

Figure 8:
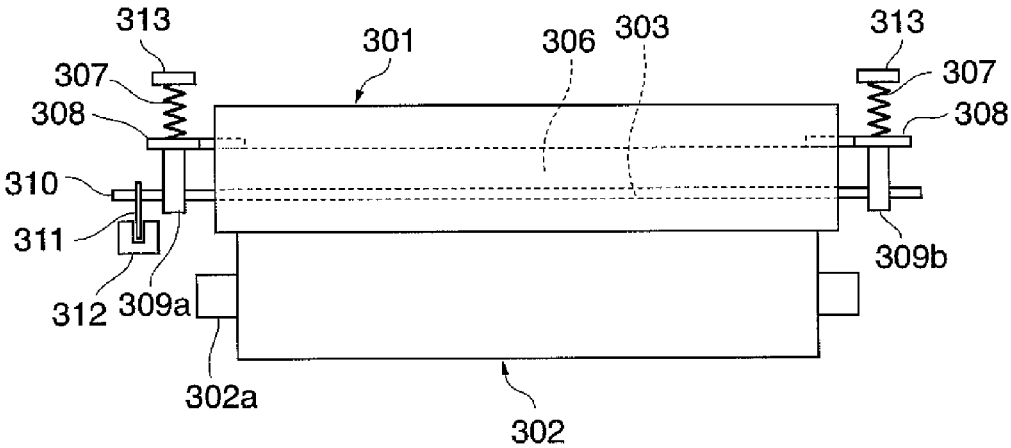
FIG. 8 is a view showing a faulty state of a pressurizing unit of the fixing device.
Figure 9:
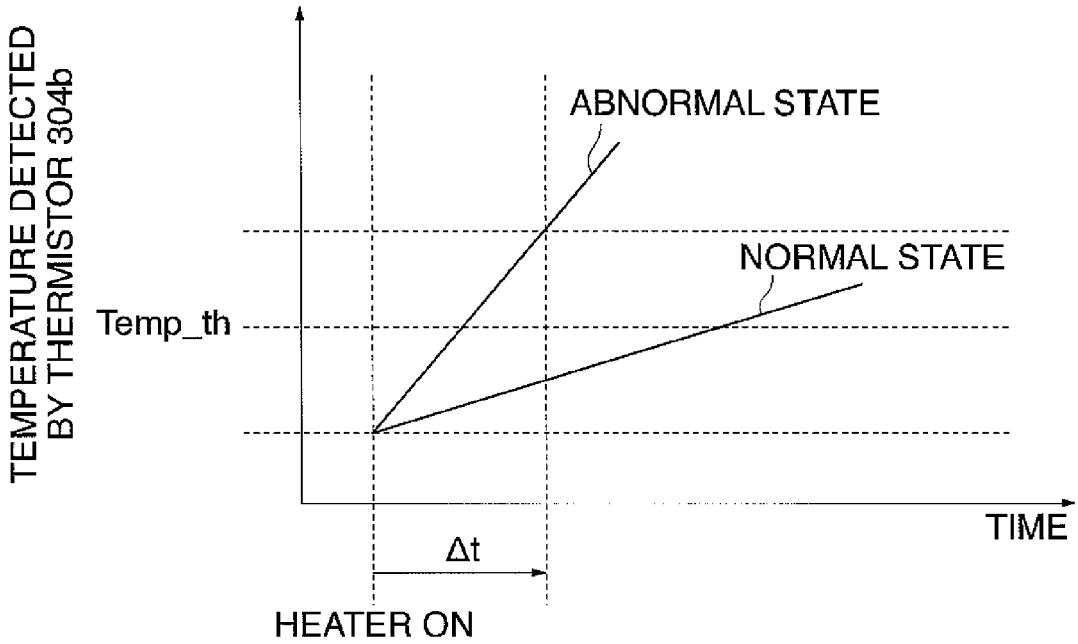
FIG. 9 is a diagram showing changes in temperature detected by a thermistor.
Figure 10:
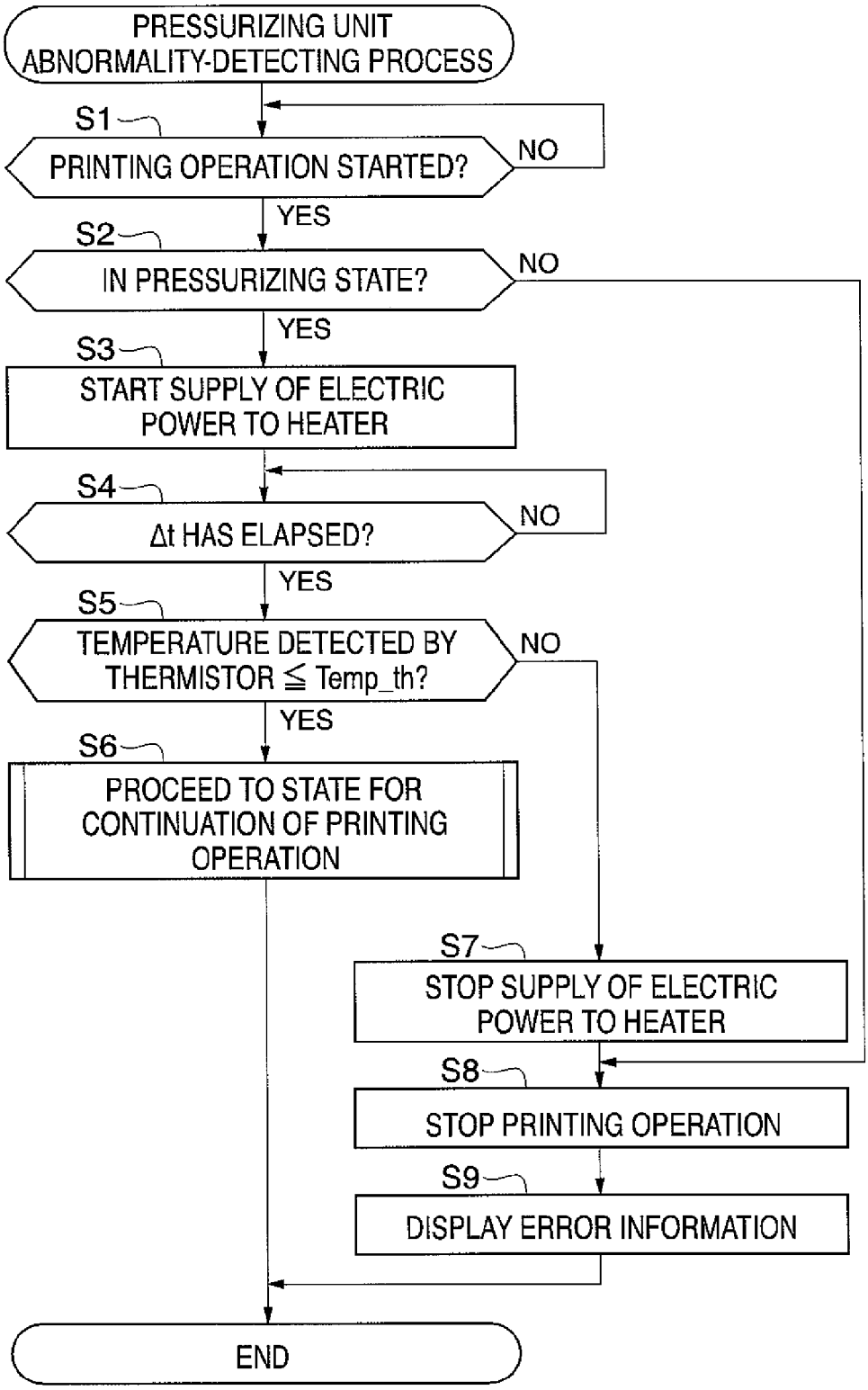
FIG. 10 is a flowchart of a pressurizing unit abnormality-detecting process executed by a controller of the image forming apparatus.

Next, a process (pressurizing unit abnormality-detecting process) for detecting whether or not an abnormality has occurred in the pressurizing unit 210 will be described with reference to FIGS. 8 to 10. FIG. 8 shows an abnormal state of the pressurizing unit 210. More specifically, FIG. 8 shows a case where the flag member 311 is in the position (first reference position) for blocking the optical path of the photosensor 312 in spite of the fixing belt 301 being in the unpressurized state. FIG. 9 is a diagram showing changes in the temperature detected by the thermistor 304*b* when the heater 305 is energized in the abnormal state of the pressurizing unit 210, shown in FIG. 8, and in the normal state of the same. FIG. 10 is a flowchart of the pressurizing unit abnormality-detecting process executed by the controller 200. The process shown in the flowchart in FIG. 10 is executed by the controller 200 (CPU 201) according to a program stored in the ROM 203.

Now, let it be assumed that an abnormality, as shown in FIG. 8 by way of example, has occurred that the flag member 311 is in the position (first reference position) for blocking the optical path of the photosensor 312 when the fixing belt 301 is in the unpressurized state. It is considered that this abnormality can occur due to a shift of the cam 309*a* or 309*b* or the flag member 311 from its normal position. When such an abnormality occurs, the photosensor 312 outputs the detection signal indicating that the pressurizing unit 210 is in the pressurizing state for causing the fixing belt 301 to be pressurized. The outputting of the detection signal causes the heater power supply circuit 211 to make electrically continuous the power supply path leading to the heater 305 to thereby enable energization of the heater 305. Further, although the fixing belt 301 is in the unpressurized state in actuality, the controller 200 erroneously recognizes, due to output of the detection signal, that the fixing belt 301 is in the pressurized state.

If the controller 200 turns on the triac 701 in this state, supply of electric power to the heater 305 is started. Assuming that supply of electric power to the heater 305 is started in the unpressurized state of the fixing belt 301, the temperature detected by each of the thermistors 304*a* to 304*c* rises more sharply than when electric power is supplied to the heater 305 in the pressurized state of the fixing belt 301.

For example, as shown in FIG. 9, the temperature detected by the thermistor 304*b* during supply of electric power to the heater 305 in the unpressurized state of the fixing belt 301 (i.e. in the abnormal state) rises more sharply than during supply of electric power the heater 305 in the pressurized state of the fixing belt 301 (i.e. in the normal state).

In view of this, in the present embodiment, the pressurizing unit abnormality-detecting process is executed for detecting occurrence of an abnormality in the pressurizing unit 210 by detecting a sharp rise in the temperature which takes place when the abnormality (FIG. 8) described above by way of example has occurred in the pressurizing unit 210. Specifically, in the pressurizing unit abnormality-detecting process, it is determined whether or not a temperature detected by the thermistor 304*b* upon the lapse of a predetermined time period Δt after the start of supply of electric power to the heater 305 is not higher than a preset threshold value Temp_th, and if the temperature detected by the thermistor 304*b* is higher than the preset threshold value Temp_th, the triac 701 is turned off to forcibly stop energization of the heater 305. That is, the supply of electric power to the heater 305 is stopped.

The pressurizing unit abnormality-detecting process will be described in detail with reference to FIG. 10.

As shown in FIG. 10, when a printing operation is started (step S1), the controller 200 detects, based on the detection signal from the photosensor 312, whether or not the pressurizing unit 210 causes pressure to be applied to the fixing belt 301 (step S2). If the pressurizing unit 210 is not applying pressure to the fixing belt 301, the controller 200 judges that an abnormality of not applying pressure to the fixing belt 301 has occurred in the pressurizing unit 210, and stops the printing operation (step S8). Then, the controller 200 displays error information indicating that the fixing belt 301 is not in the pressurized state on the operation panel 150 (step S9), followed by terminating the present process.

If it is determined in the step S2 that the pressurizing unit 210 is applying pressure to the fixing belt 301, the controller 200 turns on the triac 701 of the heater power supply circuit 211 to start supply of electric power to the heater 305 (i.e. energization of the heater 305) (step S3). At the same time, the controller 200 starts up a built-in timer. Then, while monitoring the timer, the controller 200 awaits lapse of the predetermined time period Δt after the start of the supply of electric power to the heater 305 (step S4).

When the predetermined time period Δt has elapsed after the start of the supply of electric power to the heater 305, the controller 200 takes a temperature detected by the thermistor 304*b* and determines whether the temperature is not higher than the threshold value Temp_th (step S5). If the temperature is not higher than the threshold value Temp_th, the controller 200 determines that the fixing belt 301 is actually in the pressurized state as the detection signal indicates, i.e. that no abnormality has occurred in the pressurizing unit 210. Then, the controller 200 proceeds to a state for continuing the printing operation (step S6), followed by terminating the present process. This causes the printing operation to be continued.

If it is determined in the step S5 that the temperature detected by the thermistor 304*b* is higher than the threshold value Temp_th, the controller 200 judges that an abnormality has occurred in the pressurizing unit 210. More specifically, the abnormality has occurred that although the fixing belt 301 is actually in the unpressurized state, the detection signal from the photosensor 302 indicates the pressurized state of the fixing belt 301. Based on the judgment, the controller 200 turns off the triac 701 to stop the supply of electric power to the heater 305 (step S7).

Then, the controller 200 stops the printing operation (step S8). Thereafter, the controller 200 displays the error information indicating that the fixing belt 301 is in the unpressurized state on the operation panel 150 (step S9), followed by terminating the present process.

As described above, according to the present embodiment, it is possible to determine that although the fixing belt 301 is actually in the unpressurized state, an error of detecting the pressurized state of the fixing belt 301 has occurred. This makes it possible to prevent the fixing belt 301 and the heater 305 from being damaged due to supply (continuation) of electric power to the heater 305 in the unpressurized state of the fixing belt 301.

Although in the present embodiment, only the temperature detected by the thermistor 304*b* disposed in the central part of the heater holder 303 is used to determine whether or not an abnormality has occurred in the pressurizing unit 210, this is not limitative, but temperatures detected by the respective thermistors 304*a* to 304*c* may be taken by the controller 200, for example. In this case, if any one of the detected temperatures exceeds the threshold value Temp_th, it is judged that an abnormality has occurred in the pressurizing unit 210, and the supply of electric power to the heater 305 is stopped. Alternatively, the average value of the temperatures detected by the respective thermistors 304*a* to 304*c* may be calculated. In this case, if the average value exceeds the threshold value Temp_th, it is judged that an abnormality has occurred in the pressurizing unit 210, and the supply of electric power to the heater 305 is stopped.

Figure 11:
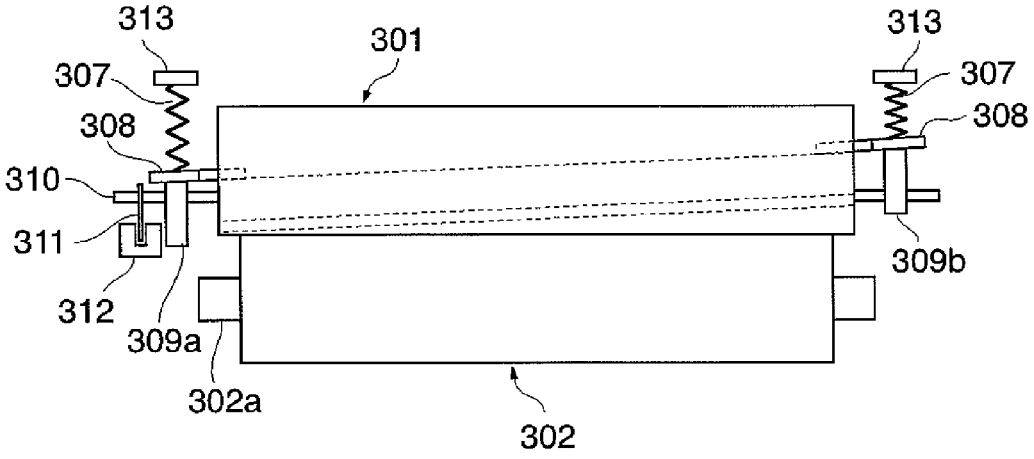
FIG. 11 is a view showing a faulty state of the pressurizing unit of the fixing device.
Figure 12:
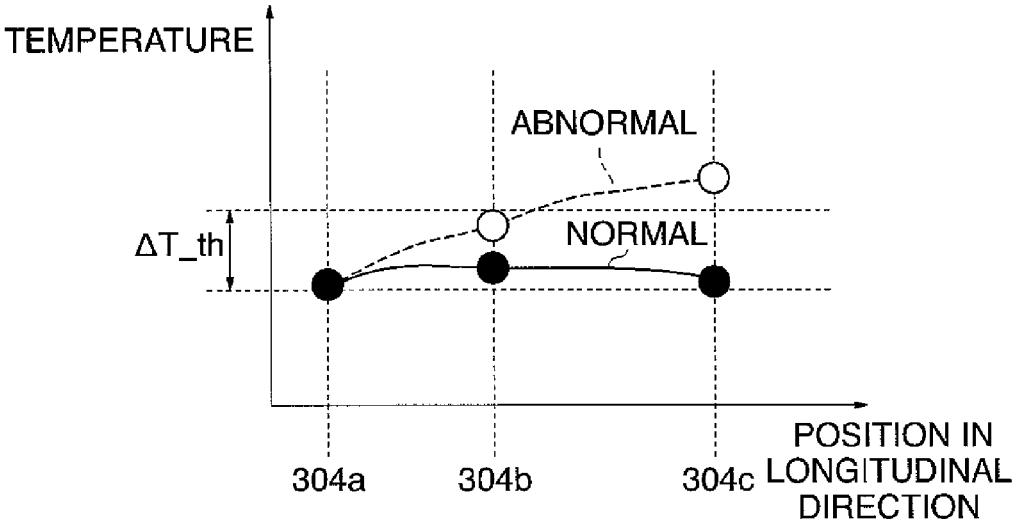
FIG. 12 is a diagram showing temperatures detected by the respective thermistors.
Figure 13:
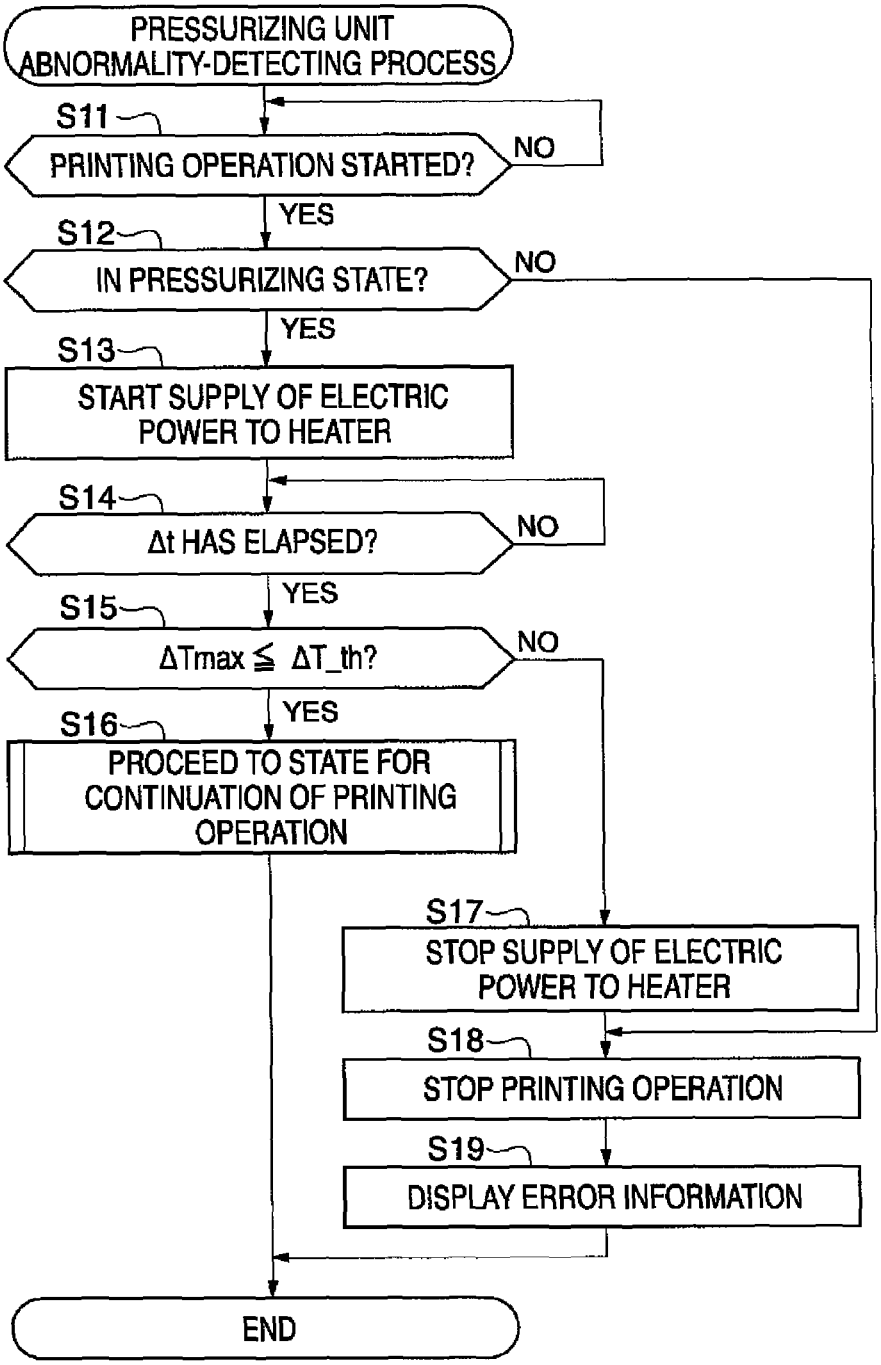
FIG. 13 is a flowchart of a pressurizing unit abnormality-detecting process executed by a controller of an image forming apparatus according to a second embodiment of the present invention.
Figure 14:
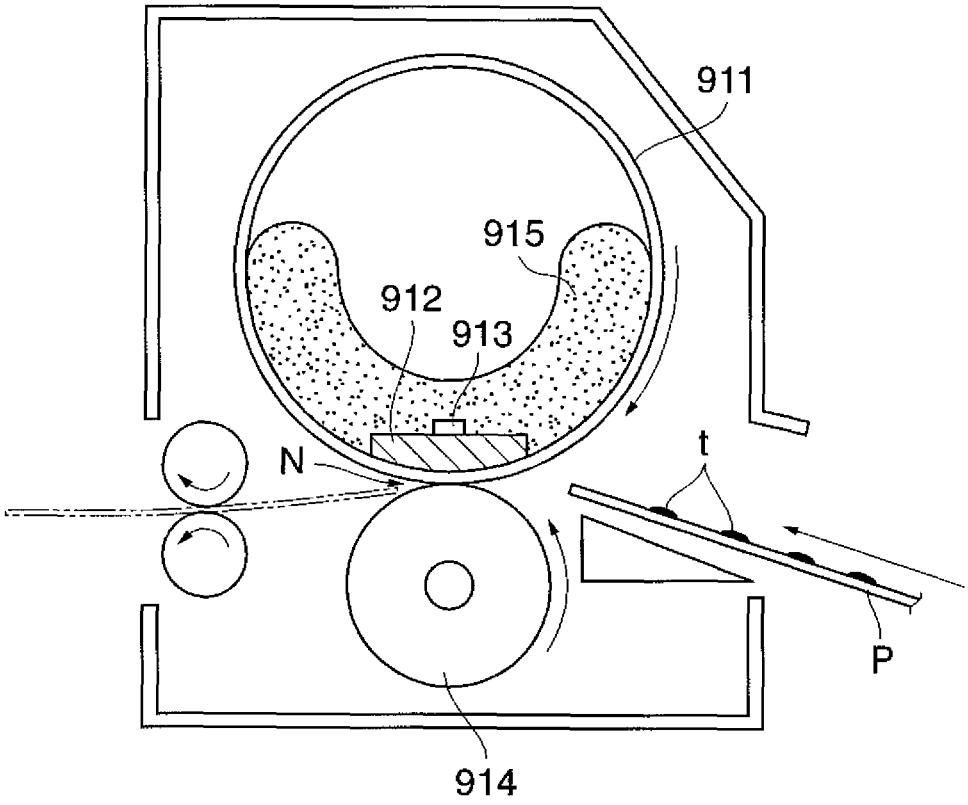
FIG. 14 RELATED ART
FIG. 14 is a longitudinal cross-sectional view of essential parts of a conventional fixing device using a fixing film.

Next, a second embodiment of the present invention will be described with reference to FIGS. 11 to 13. FIG. 11 is a view showing a faulty state of the pressurizing unit 210. FIG. 12 is a diagram showing temperatures detected by the thermistors 304*a* to 304*c* upon the lapse of the predetermined time period Δt after the start of supply of electric power to the heater 305 in the faulty state, shown in FIG. 11, of the pressurizing unit 210. FIG. 13 is a flowchart of a pressurizing unit abnormality-detecting process executed by the controller 200 of an image forming apparatus according to the second embodiment.

The image forming apparatus according to the present embodiment has the same construction as the image forming apparatus according to the above-described first embodiment, and therefore description thereof is omitted, with the same reference numerals denoting the same components.

According to the present embodiment, when an abnormality occurs that the pressurizing unit 210 cannot apply pressure to the fixing belt 301 uniformly with respect to the longitudinal direction of the same, it is possible to detect the abnormality and stop supply of electric power to the heater 305.

For example, as shown in FIG. 11, an event can occur that the cam 309*a* (left one as viewed in FIG. 11) is in a position for applying pressure to the fixing belt 301, whereas the cam 309*b* (right one as viewed in FIG. 11) is not. It is considered that this abnormality can occur due to a shift of the cam 309*b* from its normal position caused by rotation of the same on the drive shaft 310.

In this abnormal case, the cam 309*a* is in the position for applying pressure to the fixing belt 301, and the flag member 311 is in the first reference position for blocking the optical path of the photosensor 312. As a consequence, the controller 200 recognizes that the fixing belt 301 is in the pressurized state. However, since the cam 309*b* is not in the position for applying pressure to the fixing belt 301, the pressurizing unit 210 cannot apply pressure to the fixing belt 301 uniformly with respect to the longitudinal direction of the same. More specifically, a portion of the fixing belt 301 closer to the cam 309*a* is pressed, whereas a portion of the fixing belt 301 closer to the cam 309*b* is not.

In this case, at a time point when the predetermined time period Δt has elapsed after the start of energization of the heater 305, temperatures (i.e. temperatures of the heater 305) detected by the respective thermistors 304*a* to 304*c* are distributed as indicated by a dotted line in FIG. 12. More specifically, in the abnormal state of the pressurizing unit 210, the temperatures detected in the positions of the respective thermistors 304*a* to 304*c* on the fixing belt 301 in the longitudinal direction of the same show that the temperature of the fixing belt 301 (or the heater 305) becomes increasingly higher from one end (pressurized side) toward the other (unpressurized side).

In contrast, in the normal state of the pressurizing unit 210, the cams 309*a* and 309*b* are each in the position for applying pressure to the fixing belt 301, so that the pressurizing unit 210 can apply pressure to the fixing belt 301 uniformly with respect to the longitudinal direction of the same. In the case of this normal state of the pressurizing unit 210, at the time point when the predetermined time period Δt has elapsed after the start of energization of the heater 305, temperatures detected by the respective thermistors 304*a* to 304*c* are distributed as indicated by a solid line in FIG. 12. More specifically, in the case of the normal state of the pressurizing unit 210, the temperatures detected in the positions of the respective thermistors 304*a* to 304*c* on the fixing belt 301 (or the heater 305) in the longitudinal direction of the same are substantially equal to each other.

As described above, in the faulty state of the pressurizing unit 210 where the fixing belt 301 is not pressurized uniformly with respect to the longitudinal direction, differences produced between temperatures detected by the respective thermistors 304*a* to 304*c* are larger than in the normal state of the same.

Therefore, in the present embodiment, based on the differences produced between temperatures detected by the respective thermistors 304*a* to 304*c*, it is detected whether or not the abnormality that the fixing belt 301 is not pressurized uniformly with respect to the longitudinal direction has occurred in the pressurizing unit 210.

Next, the pressurizing unit abnormality-detecting process according to the present embodiment will be described with reference to FIG. 13.

As shown in FIG. 13, when a printing operation is started (step S11), the controller 200 detects, based on the detection signal from the photosensor 312, whether or not the pressurizing unit is applying pressure to the fixing belt 301 (step S12). If it is detected that the pressurizing unit 210 is not applying pressure to the fixing belt 301, the controller 200 judges that an abnormality of not applying pressure to the fixing belt 301 has occurred in the pressurizing unit 210, and stops the printing operation (step S18). Then, the controller 200 displays on the operation panel 150 error information indicative of occurrence of the abnormality that the pressurizing unit is not applying pressure to the fixing belt 301 (step S19), followed by terminating the present process.

If it is detected in the step S12 that the pressurizing unit 210 is applying pressure to the fixing belt 301, the controller 200 turns on the triac 701 to start supply of electric power to the heater 305 (i.e. energization of the heater 305) (step S13). Then, the controller 200 awaits the lapse of the predetermined time period Δt after the start of the supply of electric power to the heater 305 (step S14).

When the predetermined time period Δt has elapsed after the start of the supply of electric power to the heater 305, the controller 200 determines whether a maximum temperature difference ΔTmax indicative of the difference between a maximum value and a minimum value among temperatures detected by the respective thermistors 304*a* to 304*c* is not larger than a threshold value ΔT_th (step S15). If the maximum temperature difference ΔTmax is not larger than the threshold value ΔT_th, the controller 200 determines that the fixing belt 301 is normally being pressed, i.e. that no abnormality has occurred in the pressurizing unit 210. Then, the controller 200 proceeds to a state for continuing the printing operation (step S16), followed by terminating the present process. Thus, the printing operation is continued without being stopped.

If it is determined in the step S15 that the maximum temperature difference ΔTmax is larger than the threshold value ΔT_th, the controller 200 turns off the triac 701 to stop the supply of electric power to the heater 305 (step S17). In short, the energization of the heater 305 is forcibly stopped. Then, determining that an abnormality of not applying pressure to the fixing belt 301 uniformly with respect to the longitudinal direction has occurred in the pressurizing unit 210, the controller 200 stops the printing operation (step S18). Thereafter, the controller 200 displays on the operation panel 150 error information indicative of occurrence of the abnormality that the pressurizing unit 210 is not applying pressure to the fixing belt 301 uniformly with respect to the longitudinal direction of the same (step S19), followed by terminating the present process.

As described above, according to the present embodiment, it is possible to detect the abnormality the fixing belt 301 being not uniformly pressurized with respect to the longitudinal direction of the fixing belt 301 is erroneously detected. This makes it possible to prevent the fixing belt 301 and the heater 305 from being damaged due to continuation of supply of electric power to the heater 305 in such a state of the fixing belt 301.

In the first embodiment, with the precondition of the possibility of occurrence of the abnormality of the pressurizing unit 210 shown in FIG. 8, detection of the abnormality is performed based on whether the temperature detected by the thermistor 304*b* is not higher than the threshold value Temp_th. On the other hand, in the second embodiment, with the precondition of the possibility of occurrence of the abnormality of the pressurizing unit 210 shown in FIG. 11, detection of the abnormality is performed based on a difference between temperatures detected by the respective thermistors 304*a* to 304*c*.

Therefore, in order to make it possible to detect the abnormalities shown in FIGS. 8 and 11, in a manner discriminating them from each other, the step S5 in FIG. 10 and the step S15 in FIG. 13 may be executed in the same pressurizing unit abnormality-detecting process. That is, in this case, if a temperature detected by the thermistor 304*b* is higher than the threshold value Temp_th (step S5), occurrence of the abnormality shown in FIG. 8 is detected, while if the maximum temperature difference ΔTmax of the temperature differences between temperatures detected by the respective thermistors 304*a* to 304*c* is larger than the threshold value ΔT_th (step S15), occurrence of the abnormality shown in FIG. 11 is detected.

Further, it may be determined whether or not the pressurizing unit is abnormal, using a rate of change in temperature instead of determining whether or not the temperature detected in the step S5 in FIG. 10 is higher than the threshold value Temp_th. That is, in this case, by making use of the phenomenon that the rate of change in the temperature of the fixing belt 301 differs between the pressurized state and the unpressurized state thereof, as shown in FIG. 9, the temperature is detected at a first time and a second time, and if a rate of change in temperature therebetween is not smaller than a predetermined value, it is determined that the pressurizing unit is abnormal.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims priority from Japanese Patent Application No. 2007-143848 filed 30 May 2007, which is hereby incorporated by reference herein in its entirety.

What is claimed is:

1. An image forming apparatus comprising:

an image forming unit configured to form a toner image on a transfer material;

a fixing device configured to fix the toner image on the transfer material, the fixing device including a first fixing member heatable by a heating member, and a second fixing member, wherein the first fixing member and the second fixing member are pressible against each other to form a nip between the first fixing member and the second fixing member, for nipping the transfer material to convey the transfer material through the nip while heating and pressing the transfer material;

a pressurizing unit configured to be selectively switchable between a pressurizing state for causing the first fixing member and the second fixing member to be pressed against each other and an unpressurizing state in which the pressurizing state is released;

a pressurizing state-detecting unit configured to detect whether the first fixing member and the second fixing member are in the pressurizing state;

a temperature-detecting unit configured to detect a temperature of the fixing device;

a power supply unit configured to supply electric power to the heating member;

a protection unit configured to allow, when the pressurizing state-detecting unit detects that the pressurizing unit is in the pressurizing state, the power supply unit to supply electric power to the heating member, and to cut off, when the pressurizing state-detecting unit detects that the pressurizing unit is in the unpressurizing state, the supply of electric power to the heating member by the power supply unit; and a control unit configured to:

cause, when the toner image is formed on the transfer material, the pressurizing unit to switch to the pressurizing state; and determine that an abnormality occurs in the pressurizing unit and cause the power supply unit to stop the supply of electric power to the heating member, when a temperature detected by the temperature-detecting unit exceeds a predetermined temperature after a lapse of a predetermined time period from the start of the supply of electric power to the heating member by the power supply unit, even if the pressurizing state-detecting unit detects that the pressurizing unit is in the pressurizing state.

2. An image forming apparatus as claimed in claim 1, wherein the temperature-detecting unit is disposed in a central part of the heating member in a longitudinal direction thereof orthogonal to a direction for conveying the transfer material.

3. An image forming apparatus as claimed in claim 1, wherein:

the temperature-detecting unit includes a plurality of temperature-detecting sensors disposed at respective different locations on the heating member in a longitudinal direction thereof orthogonal to a direction for conveying the transfer material, and the control unit causes the power supply unit to stop the supply of electric power to the heating member when a temperature detected by one of the temperature-detecting sensors exceeds the predetermined temperature after the lapse of the predetermined time period from the start of the supply of electric power to the heating member by the power supply unit.

4. An image forming apparatus as claimed in claim 1, wherein:

the temperature-detecting unit includes a plurality of temperature-detecting sensors disposed at respective different locations on the heating member in a longitudinal direction thereof, and the control unit causes the power supply unit to stop the supply of electric power to the heating member when an average value of temperatures, detected respectively by the plurality of temperature-detecting sensors exceeds the predetermined temperature after the lapse of the predetermined time period from the start of the supply of electric power to the heating member by the power supply unit.

5. An image forming apparatus comprising:

an image forming unit configured to form a toner image on a transfer material;

a fixing device configured to fix the toner image on the transfer material, the fixing device including a first fixing member heatable by a heating member, and a second fixing member, wherein the first fixing member and the second fixing member are pressible against each other to form a nip between the first fixing member and the second fixing member, for nipping the transfer material to convey the transfer material through the nip while heating and pressing the transfer material;

a pressurizing unit configured to be selectively switchable between a pressurizing state for causing the first fixing member and the second fixing member to be pressed against each other and an unpressurizing state in which the pressurizing state is released;

a pressurizing state-detecting unit configured to detect whether the first fixing member and the second fixing member are in the pressurizing state;

a temperature-detecting unit configured to detect temperature of the fixing device, the temperature-detecting unit including a plurality of temperature-detecting sensors disposed at respective different locations on the heating member in a longitudinal direction orthogonal to a direction for conveying the transfer material;

a power supply unit configured to supply electric power to the heating member;

a protection unit configured to allow, when the pressurizing state-detecting unit detects that the pressurizing unit is in the pressurizing state, the power supply unit to supply electric power to the heating member, and to cut off, when the pressurizing state-detecting unit detects that the pressurizing unit is in the unpressurizing state, the supply of electric power to the heating member by the power supply unit; and a control unit configured to:

cause, when the toner image is formed on the transfer material, the pressurizing unit to switch to the pressurizing state; and determine that an abnormality occurs in the pressurizing unit and cause the power supply unit to stop the supply of electric power to the heating member, when a difference between a maximum value and a minimum value of temperatures detected by the plurality of temperature-detecting sensors exceeds a predetermined value after a lapse of a predetermined time period from the start of the supply of electric power to the heating member by the power supply unit, even if the pressurizing state-detecting unit detects that the pressurizing unit is in the pressurizing state.

6. An image forming apparatus as claimed in claim 5, wherein the control unit is configured to cause, when the difference exceeds a predetermined threshold value, the power supply unit to stop the supply of electric power to the heating member.

7. An image forming apparatus as claimed in claim 1, wherein the control unit allows, when the pressurizing state-detecting unit detects that the first fixing member and the second fixing member are in the pressurizing state, the power supply unit to supply electric power to the heating member, and inhibits, when the pressurizing state-detecting unit does not detect that the first fixing member and the second fixing member are in the pressurizing state, the power supply unit from supplying electric power to the heating member.

8. An image forming apparatus as claimed in claim 1, wherein the control unit causes the power supply unit to stop the supply of electric power to the heating member when the temperature detected by the temperature-detecting unit exceeds the predetermined temperature after the lapse of the predetermined time period from the start of the supply of electric power to the heating member by the power supply unit.

9. An image forming apparatus as claimed in claim 1, further comprising:

a display unit, wherein the control unit causes the display unit to display information indicating that the abnormally occurs when the control unit determines that the abnormally occurs.

10. An image forming apparatus as claimed in claim 1, wherein the control unit determines that the abnormality occurs in the pressurizing unit even when the pressurizing state-detecting unit detects that the first fixing member and the second fixing member are in the pressurizing state, when the temperature detected by the temperature-detecting unit exceeds the predetermined temperature after the lapse of the predetermined time period from the start of the supply of power supply to the heating member by the power supply unit.

11. An image forming apparatus as claimed in claim 5, wherein the control unit allows, when the pressurizing state-detecting unit detects that the first fixing member and the second fixing member are in the pressurizing state, the power supply unit to supply electric power to the heating member, and inhibits, when the pressurizing state-detecting unit does not detect that the first fixing member and the second fixing member are in the pressurizing state, the power supply unit from supplying electric power to the heating member.

12. An image forming apparatus as claimed in claim 5, wherein the control unit causes the power supply unit to stop the supply of electric power to the heating member when the difference exceeds the predetermined value after the lapse of the predetermined time period from the start of the supply of electric power to the heating member by the power supply unit.

13. An image forming apparatus as claimed in claim 5, further comprising:

a display unit, wherein the control unit causes the display unit to display information indicating that the abnormally occurs when the control unit determines that the abnormally occurs.

14. An image forming apparatus as claimed in claim 5, wherein the control unit determines that the abnormality occurs in the pressurizing unit even when the pressurizing state-detecting unit detects that the first fixing member and the second fixing member are in the pressurizing state, when the difference exceeds the predetermined value after the lapse of the predetermined time period from the start of the supply of electric power to the heating member by the power supply unit.

* * * * *